United States Patent [19]

Rensch

[11] 3,999,351

[45] Dec. 28, 1976

[54] STRUCTURAL FRAME

[76] Inventor: Eberhard G. Rensch, Lerchesbergring 24, D-6 Frankfurt am Main, Germany

[22] Filed: Oct. 14, 1971

[21] Appl. No.: 189,461

[30] Foreign Application Priority Data

Nov. 5, 1970 Germany ..... 2054385
Sept. 22, 1971 Germany ..... 2147242

[52] U.S. Cl. ..... 52/648; 52/280; 52/282; 52/494; 52/721

[51] Int. Cl.[2] ..... E04H 12/00

[58] Field of Search ..... 52/637, 638, 721, 731, 52/729, 280, 645, 237, 73, 481, DIG. 8, 733, 483, 488, 264, 282, 494, 648

[56] References Cited

UNITED STATES PATENTS

| | | | |
|---|---|---|---|
| 217,316 | 7/1879 | Asper | 52/638 |
| 1,725,439 | 8/1929 | Carns | 52/729 |
| 1,911,413 | 5/1933 | Wait | 52/729 |
| 2,046,152 | 6/1936 | Dean | 52/721 X |
| 2,078,968 | 5/1937 | Patterson | 52/278 X |
| 2,439,129 | 4/1948 | Donahue et al. | 52/721 |
| 2,922,299 | 1/1960 | Dean | 52/263 X |
| 2,959,256 | 11/1960 | Dean | 52/263 X |
| 2,970,676 | 2/1961 | Maciunas | 52/488 |
| 3,282,005 | 11/1966 | Birdwell | 52/731 X |
| 3,503,166 | 3/1970 | Nakazawa et al. | 52/282 X |
| 3,633,325 | 1/1972 | Bartoli | 52/237 X |

FOREIGN PATENTS OR APPLICATIONS

| | | | |
|---|---|---|---|
| 1,009,371 | 7/1965 | United Kingdom | 52/645 |

*Primary Examiner*—Ernest R. Purser
*Assistant Examiner*—Carl D. Friedman
*Attorney, Agent, or Firm*—Karl F. Ross; Herbert Dubno

[57] ABSTRACT

A column of hexagonal profile, or of H-profile complemented by a pair of flanking inserts to a hexagon, is fitted to a beam-engaging joint by embracing or entering a hexagonal core thereof from which six arms radiate in different directions. The column may have lugs or flanges rising beyond its body and fitting between adjacent joint arms while the core rests on the top of the column. Longitudinal grooves in the column body, extending along the corners of the hexagon, serve to receive edge portions of elongate brackets designed to secure associated wall elements to the column.

11 Claims, 12 Drawing Figures

STRUCTURAL FRAME

My present invention relates to a structural framework for building purposes which in a horizontal plane includes a system of girders or beams in the form of a preferably triangular grid, these girders being attached to radially extending arms via star-profile joints mounted in columns. The joints may comprise a simple star profile of intersecting arms or may include hollow or solid cores of polygonal, especially hexagonal, cross-section with the profile arms radiating from the corners of the polygon in angularly equispaced relationship. Such joints have been disclosed in several copending applications of mine, including Ser. No. 886,655 filed Dec. 19, 1969, now U.S. Pat. No. 3,686,812, and Ser. No. 38,214 filed May 18, 1970, now U.S. Pat. No. 3,688,461. The object of my invention is to provide, in such a framework, a column construction simplifying the assembly of the interconnected elements.

In accordance with a feature of my present invention, the columns supporting the grid-forming beams or girders at an elevated level consist at least in part of uprights, solid or tubular, terminating at that level in joints connecting each column to a plurality of girders which radiate in different directions, each of these joints having a polygonal core seated atop the associated column; the core is provided with girder-engaging arms radiating from the corners of the polygon and is straddled by peripherally spaced upward projections of the associated column fitting between respective pairs of these arms to hold the joint centered with reference to the column. Fastening means, such as bolts, traverse these projections and the core for retaining the joint on the column.

Advantageously, in the case of a tubular column of polygonal cross-section, the projections are lugs rising integrally from the top of the column between pairs of adjoining corners of its polygonal profile, the polygon of the joint core being geometrically similar to that of the column profile (e.g., a regular hexagon) and fitting closely inside the latter so as to rest on the column only by its arms.

According to another feature of my invention, the columns may be provided with grooves extending vertically along the corners of their polygon, below the beam level, to receive parts of brackets serving to anchor a set of wall members to the columns. The projecting portions of these brackets, engaging the wall members, may extend at least partly in vertical planes parallel to certain sides of the polygon; each bracket is advantageously bent, at its point of emergence from the groove, into a leg paralleling a hexagon side immediately adjoining that groove.

These and other features of the present invention will be described in detail hereinafter with reference to the accompanying drawing in which.

Figure 2:
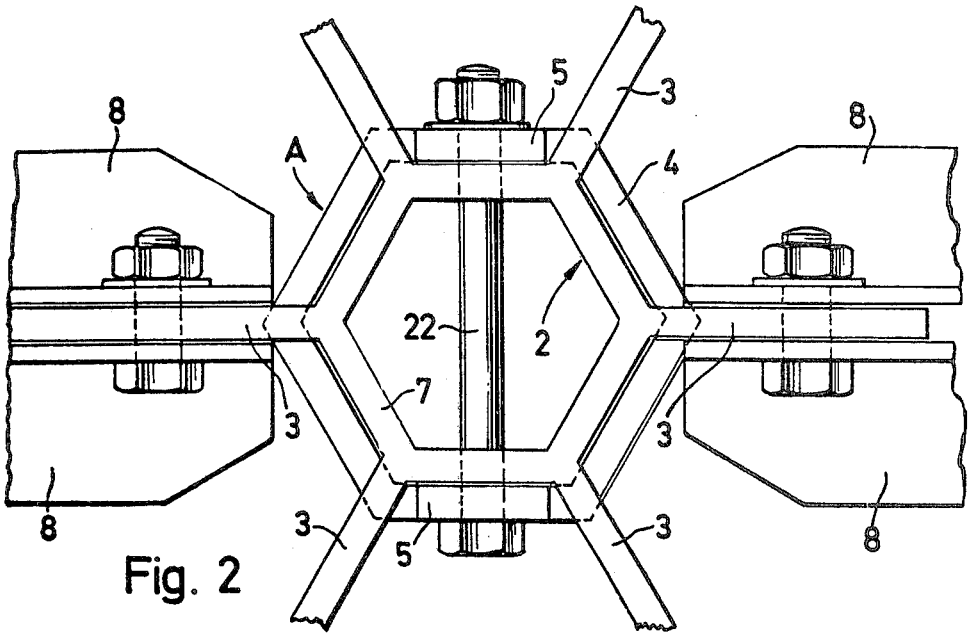
FIG. 2 is a plan view of a joint connected to one of the columns of FIG. 1.
Figure 4:
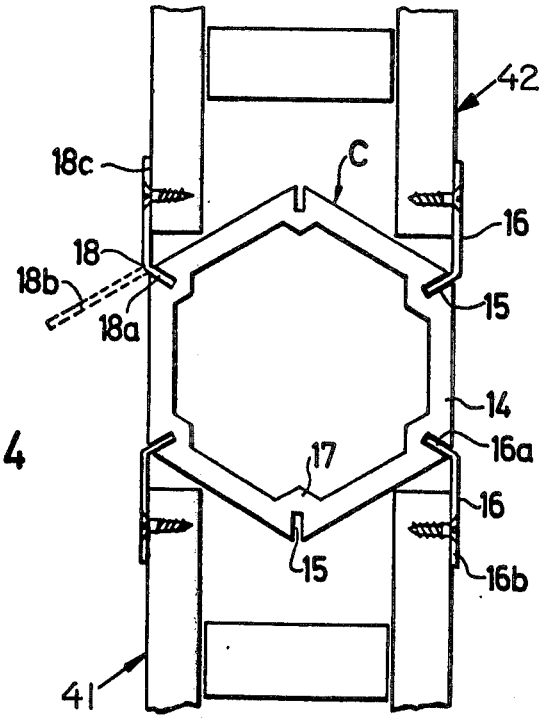
FIG. 4 is a plan view of a modified assembly of columns and wall elements.
Figure 5B:
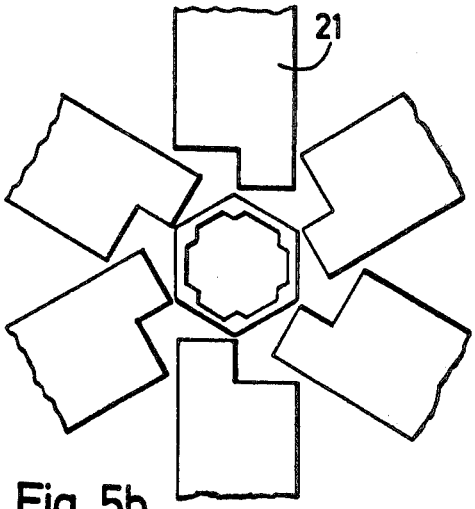
Figure 5A:
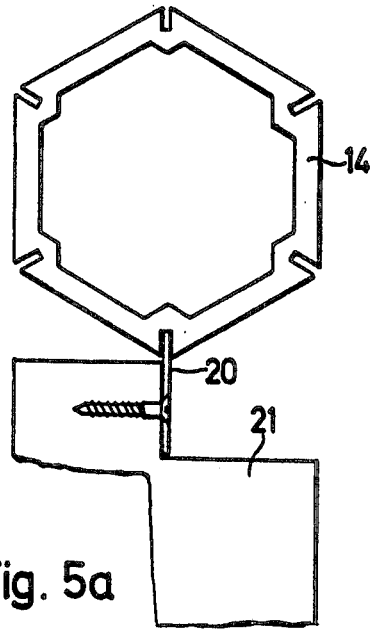
Figure 7:
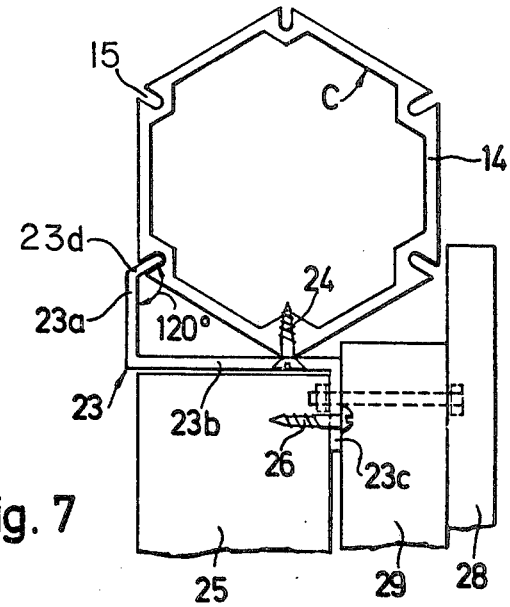
Figure 6:
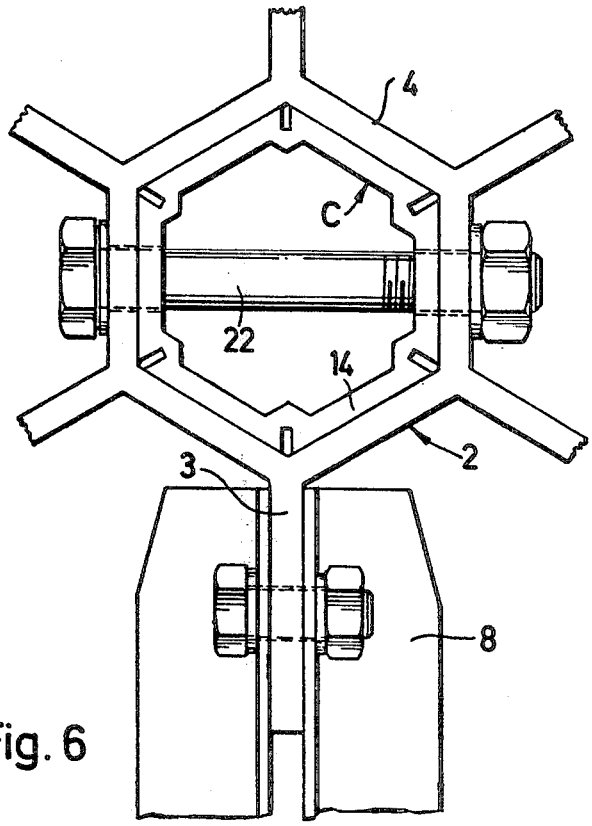
Figure 8:
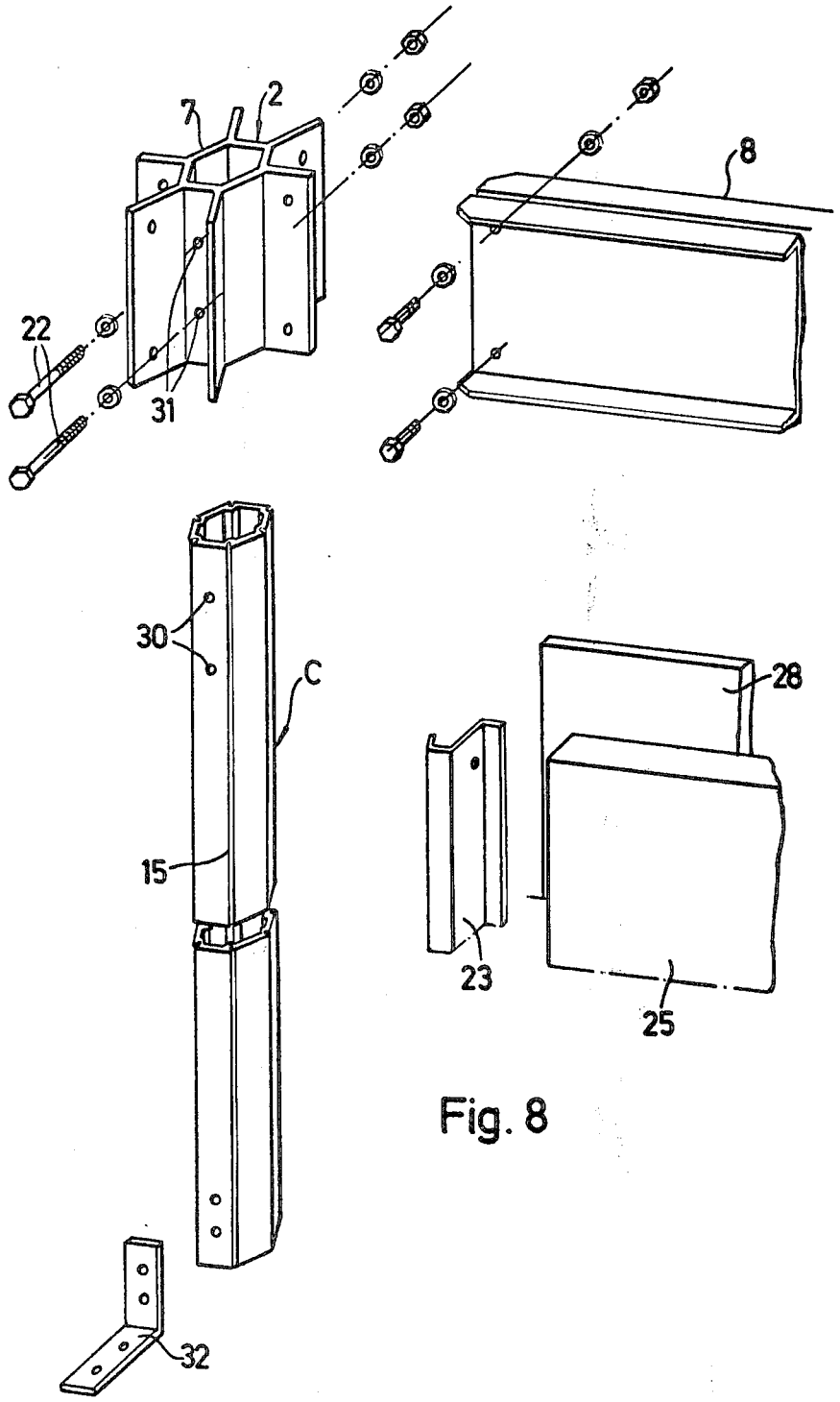
Figure 10:
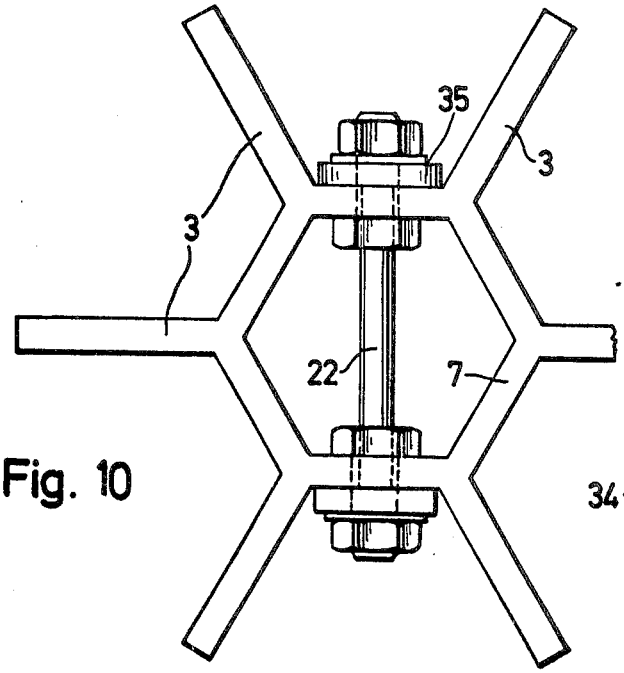
Figure 9:
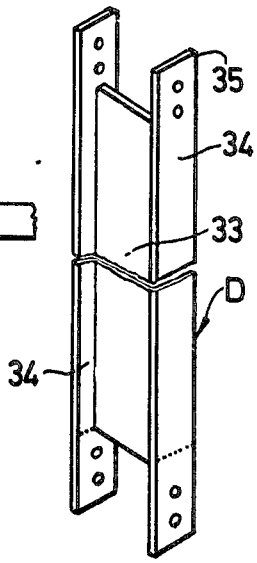

FIGS. 5*a*, 5*b* are plan views similar to FIG. 4, showing modified assemblies;

FIG. 6 is a plan view similar to FIG. 2 but including the column of FIG. 4;

FIG. 7 is a plan view similar to FIG. 4 showing a modified wall connection;

FIG. 8 is an exploded view of the assembly of FIG. 4;

FIG. 9 shows another modified column in a perspective view;

FIG. 10 is a plan view, similar to FIG. 2, including the column of FIG. 9; and

Figure 11:
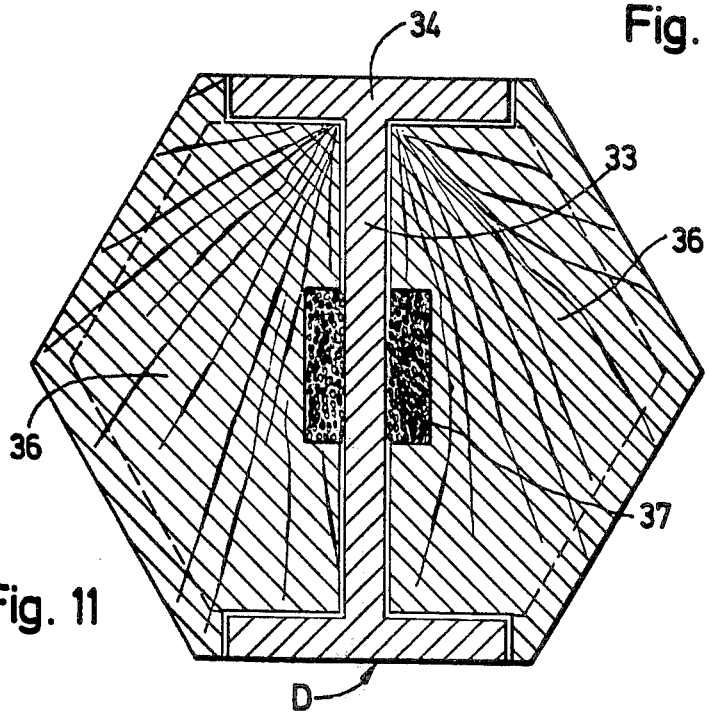

FIG. 11 is a sectional view of the column of FIG. 9 flanked by a pair of complementary inserts.

Figure 1:
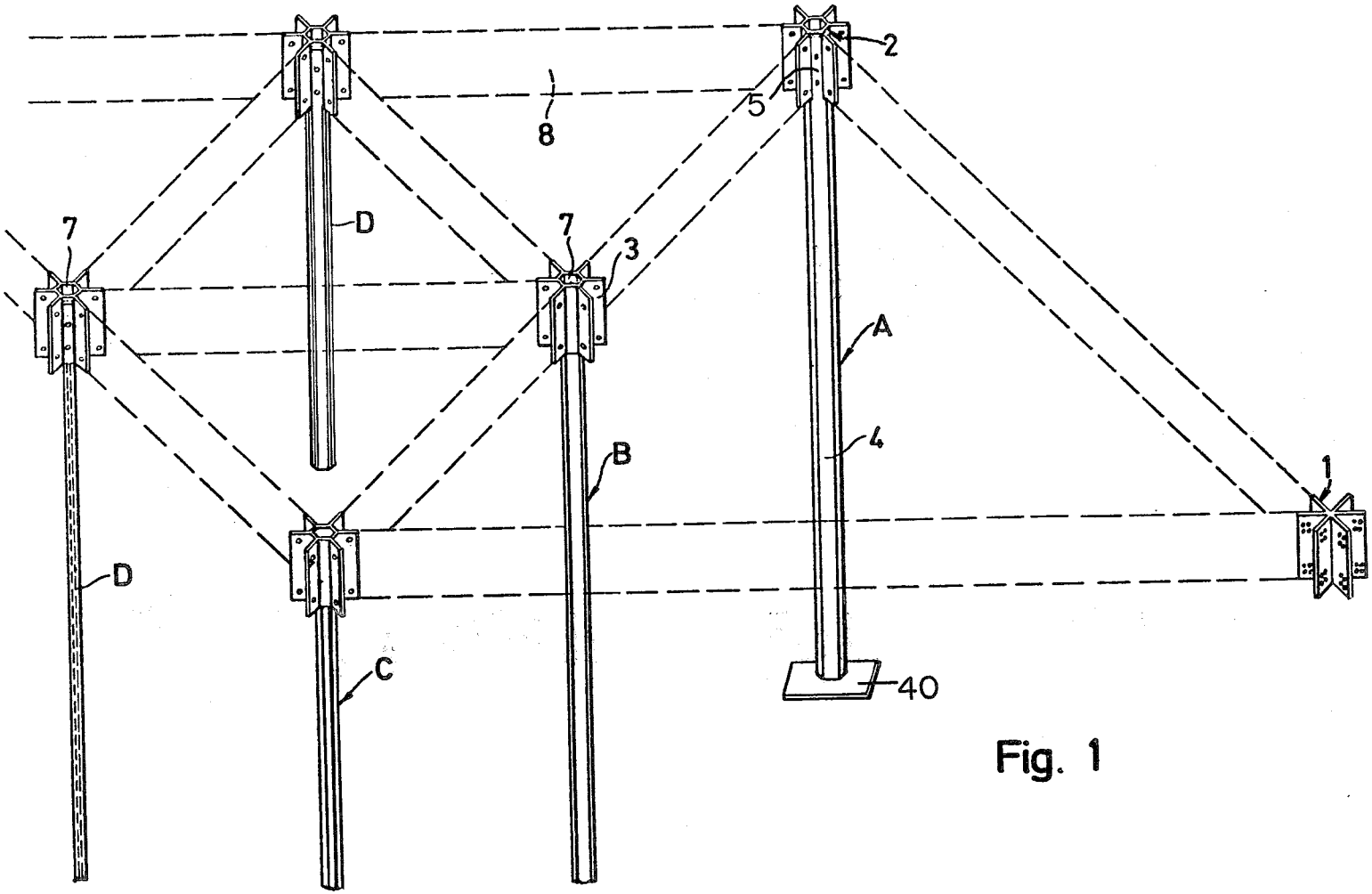
FIG. 1 is a perspective view of a building frame with various types of supporting columns and beam-engaging joints according to the present invention.

FIG. 1 shows a horizontal grid of a framework comprising joints 1, 2 and girders 8 of different dimensions. The joints 2 are supported on columns A – D at statically predetermined locations whereas other junctions are formed by unsupported star-profile joints 1 consisting merely of angularly intersecting arms. The column-supported joints 2 are each provided with a hollow core 7 facilitating their connection with the tubular columns and enabling various lines and conduits to be disposed therein. FIG. 1 shows various column configurations for the sake of illustration only; in practice, the chosen configuration will be uniform throughout the structure.

In actual use, grids with beam angles of 60° are preferred. Therefore I have shown in the drawing only joints with six arms 3 and columns of hexagonal cross-sections, or joints and columns whose cross-sections may be complemented to a hexagon.

The arms 3 are flat vertical ribs radiating from the corners of core 7 so as to be aligned with the longitudinal edges of the associated column.

Column A comprises a hexagonal tube 4 rising from a foundation illustrated in the drawing as a narrow base 40. For attachment of column A to a joint 2, the top of this column is provided with upwardly projecting lugs 5 at diametrically opposite sides of tube 4, preferably made integral therewith. Naturally, column A may also be solid rather than tubular.

FIG. 2 is a plan view of the joint 2 mounted on column A. Preferably, the dimensions of the column are such that the inner diameter of tube 4 is approximately the same as the outer diameter of the joint core 7 so that the projecting lugs 5, inserted between adjoining radially extending arms, contact the corresponding outer core walls. The width of the projections 5 should not exceed the width of the polygon sides of core 7 between adjacent profile arms 3. The lugs 5 and the adjacent wall portions of the joint are provided with corresponding holes traversed by a connecting screw 22.

Joint arms 3 rest, in the case of column A, directly on the tube 4. The horizontal girders 8 are attached in pairs to these arms. In FIG. 8 one such horizontal girder or beam has been partly illustrated in greater detail and will be seen to consist of two C-channels arranged back-to-back on opposite sides of a joint arm sandwiched therebetween (see also FIG. 6).

With multistory structural frames either end of the column is provided with the projecting lugs described above, the bottom lugs of the top column being inserted into the remaining free spaces between the joint arms so that the column comes to rest on the joint.

The supporting column shown in FIG. 1 lacks the lugs 5 and has its upper end inserted into the joint core with close fit. The parts are bolted together by screws 22, as described below with reference to FIG. 6.

Figure 3:
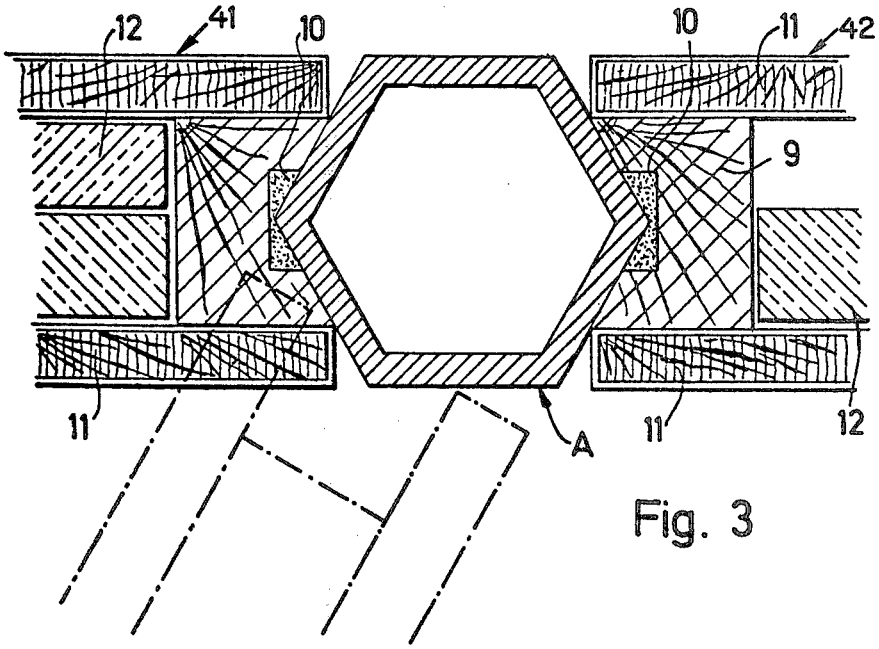
FIG. 3 is a cross-sectional view of the column of FIG. 2 in combination with adjacent wall elements.

FIG. 3 shows the connection of wall elements 41, 42 to the hexagonal column A or B. These wall elements include upright wooden liners 9 confronting respective corners of the column profile which fit into complementary recesses of the liners with interposition of fillers of permanently elastic putty 10. Laminated wood-fiber boards 11, which when used as outer walls are provided with a weatherproofing coating, flank the wooden liners 9 and are separated by insulating boards 12.

According to a further feature of my present invention, the columns A and B may be provided with supplemental wall-engaging fastening means in the form of selectively positionable longitudinally extending brackets, as illustrated in FIGS. 4 – 8 for a modification C of column B. Naturally, column A may also be modified in this manner.

Column C shown in FIGS. 4 – 8 comprises a hexagonal tube 14, but a solid hexagonal rod may also be used. This tube 14 is provided with longitudinal corner grooves 15 extending preferably along its total length and penetrating radially into the column body. Angularly bent brackets 16 are inserted into some of these grooves, by a relatively short leg 16*a*, their longer other leg 16*b* being screwed onto the wall element 41 or 42. These brackets are exchangeable and have been provided only at those corners which are in line with the outer wall surfaces. It is not essential that the brackets extend along the total length of the columns. When hexagonal columns are used, as shown in the drawing, the legs of the bracket include with each other an angle of 120° if the wall elements are to be attached so as to be flush with a hexagon side of the column profile. At 17 the inner wall of the corners is reinforced behind the grooves 15.

A modified bracket 18 may also be used for interconnecting two wall elements. As shown in FIG. 4, bracket 18 includes several portions 18*b*, 18*c* bent into different directions, 120° apart, with reference to a groove-engaging part 18*a*.

FIG. 5*a* shows a flat strip 20 fastened to a wall element 21 whose end facing the column 14 has been provided with a stepped shoulder. FIG. 5*b* shows a diagrammatic view of possible connections of wall elements 21 with the column C of FIG. 4. As a maximum, six of these wall elements may be connected to a hexagonal column.

FIG. 6 is a plan view of a joint 2 as used in connection with the column C. The hollow joint core 4 and the column end surrounded by it are provided with aligned bores for the passage of the screw 22 interconnecting the column and the joint. Column B can be connected with its joint in the same manner as column C.

FIG. 7 is a plan view of a column C supplemented by a bracket 23 which is bent several times and screwed to the column for orthogonal assembling of multi-layer walls. This roughly S-shaped bracket has a first leg 23*a* including an angle of 120° with an edge portion 23*d* engaging in a groove 15, this leg extending parallel to two sides of the hexagonal tube 14 to a transverse plane touching the adjacent corner; a second leg 23*b*, in that plane, orthogonally adjoins the part 23*a* and is rigidly secured to column 14 by means of a self-cutting sheet-metal screw 24 threaded into the adjacent groove 15. A third leg 23*c* orthogonally adjoins the leg 23*b* and is secured to a wall or window element 25 by means of a screw 26. Leg 23*c* may also be used to attach an outer layer 28 to a subassembly 29.

FIG. 8 is an exploded view of column C together with joint 2, horizontal girder 8, bracket 23, wall element 25, and outer layer 28 in a diagrammatic and perspective illustration, showing construction and assembly of the frame and the wall connection, with engagement of the upper end of column C in the hollow core 7 of joint 2, solidification of the connection by means of screws 22 passing through aligned bores 30 and 31, and attachment of a joint arm 3 to the horizontal channel members of girder 8. A bracket 32 serves to attach the column C to the foundation.

For the erection of multistory buildings, columns spanning the full height of the building may be used or several columns can be stacked, i.e., longitudinally connected by means of joints. FIGS. 9 – 11 show details of the column D having the form of an H-profile with a central web 33 and lateral flanges 34. Preferably, the web 33 is foreshortened so that the joint core 7 rests on it whereas the two flanges 34 have projecting extremities 35 which bracket the outer wall of the joint core in the manner of the lugs 5 of joint A (cf. FIG. 2) and are connected therewith by a screw 22. The flange extremities 35 may have stepped shoulders, thus being narrower than the central part of the flange, yet the uniform width shown in FIG. 9 is preferred. The H-shaped column D may, however, also be so dimensioned as to fit into the joint core, in which case the flange extremities are not necessary.

In one-story buildings the flanges of an H-profile column may end at the dotted lines in FIG. 9, i.e., flush with the web 33. Only in the case of multistory buildings will a relative lengthening of the flanges 34 at both ends with respect to the web 33 be required. FIG. 10 is a plan view of column D after attachment to a joint 2. In FIG. 11 an H-profile column D has been provided on either side with upright inserts 36 to obtain a cross-section of hexagonal shape. On the one hand, this results in a reinforcement of the column profile; on the other hand, in this way the same connecting means for the associated wall elements as in the case of the other embodiments can then be used. Column D is joined to inserts 36 by means of fillers 37 of elastic putty provided in recesses of the insert surfaces contacting the central web 33. The inserts may be made from wood, for example, or could be manufactured as hollow aluminum profiles.

The hexagonal columns according to the present invention as well as the frame in the form of girders and joints are preferably made of aluminum. Other materials may of course also be used as long as the same comply with the requirements of strength and processability.

Column D could also be made of steel.

What I claim is:

1. A structural framework comprising a horizontal grid formed by a multiplicity of beams; a plurality of columns supporting said beams at an elevated level, said columns consisting at least in part of uprights terminating at said level; joints for connecting each of said columns to a plurality of beams of said grid radiating in different directions, each of said joints having a polygonal core seated atop the associated column and provided with arms in the shape of flat vertical ribs radiating from the corners of its polygon, the beams radiating from the associated column being secured to respective arms of the joint, said column having peripherally spaced upward projections fitting between respective pairs of said arms and straddling said core for holding same centered with reference to the column; and fastening means traversing said projections and said core for retaining the joint on the column.

2. A framework as defined in claim 1 wherein said uprights are tubes of polygonal cross-section and said projections are lugs rising integrally from the top of the tube between pairs of adjoining corners of its cross-section, the polygon of said core being geometrically similar to that of said cross-section and fitting closely inside the latter.

3. A framework as defined in claim 2 wherein said polygons have an even number of corners, said lugs occupying diametrically opposite positions on the column polygon.

4. A framework as defined in claim 3 wherein said polygons are regular hexagons.

5. A framework as defined in claim 1 wherein each of said uprights is an H-profile with a pair of parallel flanges and a web bridging said flanges, said web being flanked by a pair of inserts complementing said profile to a polygonal upright, said flanges having upper extremities extending beyond said web and said inserts to form said projections.

6. A framework as defined in claim 1 wherein said columns have polygonal cross-sections and are provided with corner grooves extending substantially over the full height of the upright, further comprising brackets partly received in said corner grooves for linking the columns with adjoining wall members.

7. A structural framework comprising a horizontal grid formed by a multiplicity of beams; a plurality of columns of polygonal cross-section supporting said beams at an elevated level, said columns being provided at said level with joints having arms in the shape of flat vertical ribs radiating from the corners of the polygon, said arms being secured to respective beams of said grid, said columns being further provided with vertically extending grooves in line with said ribs below said level at the corners of their cross-section; brackets partly received in certain of said grooves of at least some of said columns; and wall members engaged by portions of said brackets projecting from said columns.

8. A framework as defined in claim 7 wherein said columns are tubular and are internally thickened at the corners of the polygon in the region of said grooves.

9. A framework as defined in claim 7 wherein said projecting portions extend at least partly in vertical planes parallel to certain sides of the polygon.

10. A framework as defined in claim 9 wherein each of said brackets is angularly bent, at its point of emergence from the groove partly receiving same, into a leg paralleling a polygon side immediately adjoining said groove.

11. A framework as defined in claim 10 wherein the polygon is a regular hexagon.

* * * * *